US008343588B2

(12) United States Patent
Kobori et al.

(10) Patent No.: US 8,343,588 B2
(45) Date of Patent: Jan. 1, 2013

(54) SLIDE CURTAIN COATING APPARATUS AND SLIDE CURTAIN COATING METHOD

(75) Inventors: Hideyuki Kobori, Numazu (JP); Shuji Hanai, Numazu (JP); Tomohito Shimizu, Numazu (JP); Yasuhide Takashita, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 32 days.

(21) Appl. No.: 12/958,835

(22) Filed: Dec. 2, 2010

(65) Prior Publication Data

US 2011/0070377 A1 Mar. 24, 2011

Related U.S. Application Data

(62) Division of application No. 11/901,045, filed on Sep. 14, 2007, now Pat. No. 7,870,833.

(30) Foreign Application Priority Data

Sep. 15, 2006 (JP) ..... 2006-251633

(51) Int. Cl.
*B05D 1/30* (2006.01)

(52) U.S. Cl. ..... 427/420; 118/300; 118/411; 118/412; 427/402

(58) Field of Classification Search ..... 118/300, 118/411, 412; 427/420, 402
See application file for complete search history.

(56) References Cited

U.S. PATENT DOCUMENTS 4,060,649 A 11/1977 Coleman
4,479,987 A 10/1984 Koepke et al.
4,559,896 A 12/1985 Bossard et al.
4,974,533 A * 12/1990 Ishizuka et al. ..... 118/411
5,342,815 A 8/1994 Sugiyama et al.
5,380,550 A 1/1995 Sugiyama et al.
5,395,660 A * 3/1995 Ruschak et al. ..... 427/420
5,725,665 A 3/1998 Yapel et al.
5,725,910 A 3/1998 Devine et al.

(Continued)

FOREIGN PATENT DOCUMENTS

EP 0051238 A2 5/1982

(Continued)

OTHER PUBLICATIONS

Nov. 12, 2007 European search report in connection with corressonding European patent application No. EP 07 11 6480.

(Continued)

*Primary Examiner* — Michael Cleveland
*Assistant Examiner* — Alexander Weddle
(74) *Attorney, Agent, or Firm* — Cooper & Dunham LLP

(57) ABSTRACT

To provide a slide curtain coating apparatus and method for depositing a curtain of coating liquid onto a running web, the apparatus and method capable of preventing the curtain from being condensed at its center region and preventing the resulting coating from having greater thickness at its edge regions. The coating apparatus includes: a slit for discharging the coating liquid; a slide on which the curtain flows down; and, a slide edge guide along which the curtain flows and which is provided at both edges on the slide and each having auxiliary liquid supply means at the surface facing the curtain; and auxiliary liquid supply means for discharging the auxiliary liquid from all over the surface thereof which touches the curtain at the edge guide. The coating method includes discharging the auxiliary liquid from all over the surface of the auxiliary supply means coating apparatus.

7 Claims, 6 Drawing Sheets

U.S. PATENT DOCUMENTS

| | | | | |
|---|---|---|---|---|
| 6,048,582 | A * | 4/2000 | Schweizer et al. | 427/420 |
| 6,196,127 | B1 | 3/2001 | Yamamoto et al. | |
| 2001/0020423 | A1 | 9/2001 | Yamamoto et al. | |
| 2004/0253385 | A1 | 12/2004 | Gueggi | |
| 2007/0137563 | A1 * | 6/2007 | Schweizer et al. | 118/411 |

FOREIGN PATENT DOCUMENTS

| | | | |
|---|---|---|---|
| JP | 61-35880 | | 2/1986 |
| JP | 2000-513 | | 1/2000 |
| JP | 2000-218209 | | 8/2000 |
| JP | 2001-104856 | | 4/2001 |
| JP | 2005-512768 | | 5/2005 |
| WO | WO 97/40947 | | 11/1997 |
| WO | WO 03/049870 | A1 | 6/2003 |
| WO | WO 03/049871 | A1 | 6/2003 |
| WO | WO 2005-097352 | A1 | 10/2005 |
| WO | WO 2005097352 | A1 * | 10/2005 |

OTHER PUBLICATIONS

Jan. 30, 2008 European search report in connection with corresponding European patent application No. EP 07 11 6480.

* cited by examiner

SLIDE CURTAIN COATING APPARATUS AND SLIDE CURTAIN COATING METHOD

CROSS-REFERENCE TO RELATED APPLICATION

This application is a divisional of U.S. application Ser. No. 11/901,045, now U.S. Pat. No. 7,870,833 filed Sep. 14, 2007, the entire contents of which are incorporated herein by reference.

BACKGROUND

1. Technical Field

This disclosure relates to a slide curtain coating apparatus and slide curtain coating method for applying coating liquid on a running web.

2. Description of the Related Art

Curtain coating apparatuses are commonly used in manufacturing processes of photosensitive materials such as photographic films.

FIG. 1 shows an example of a conventional curtain coating apparatus. The curtain coating apparatus 4 (or curtain coating head) includes one or more slits S as means for discharging a coating liquid 6. By discharging coating liquids 6 on the surface of a slide 1 from the multiple slits S, layers or curtain of the coating liquids 6 are formed on the surface of the slide 1. The laminate of the coating liquids 6, or curtain, then freely falls from the inclined surface of the slide 1 and contacts a web 5 running on a conveyor (not shown), forming a coating on the web 5. The curtain coating apparatus 4 further includes at least a pair of slide edge guides 2 and a pair of curtain edge guides 3. The present invention relates to an improvement of such a curtain coating apparatus.

The curtain coating method according to the present invention is directed to a method of forming a multilayer coating which involves the use of the aforementioned curtain coating apparatus, wherein coating liquids with different functions are discharged from different slits such that the coating liquids are stacked on top of each other on the slide surface to form a curtain, which then falls freely down on the running web to form a coating thereon.

A key issue in such conventional curtain coating apparatuses/methods is that, as shown in FIG. 1, the coating liquids flow slowly at the edges of the slide, i.e., as indicated by arrows A in the drawing, the flow rate of the curtain varies across its width, thereby causing a phenomenon in which edge flows converge to the slide center. As a result, the resulting coating has a greater thickness at the central region than at the edge regions. Due to such non-uniform thickness, the thicker edge regions of the coating may not completely dry in a drying process. This leads to "blocking" of the coating when it is rolled. And further, the raised edge regions can cause the web to be easily torn up when it is rolled. Thus, these drawbacks limit the efficiency of the curtain coating process. As a solution to overcome such problems, the drying temperature may be raised in the drying process; however, high drying temperatures are not desirable for the formation a for example, thermosensitive paper which develops colors upon exposure to high temperatures, leading to such problems as defective products. For this reason, this approach cannot be used for curtain coating in many cases.

Japanese Patent Application Laid-Open (JP-A) Nos. 2000-513, 2000-218209, 2001-104856 and 2005-512768 propose techniques for preventing the edge regions from becoming thicker. In the proposed techniques, an auxiliary liquid is allowed to flow essentially parallel to the flow direction of the curtain along edge guides of the slide, so that the flow rates at the opposing edges of the slide are made close to the flow rate at the center. The proposed techniques are disadvantageous in that, since a large amount of the auxiliary liquid needs to be supplied along the edges of the slide, the auxiliary liquid may be easily mixed with the curtain. And further, these technique have met with difficulties in stably and uniformly supplying the auxiliary liquid along the edge regions, resulting in non-uniform in thickness along its width. An additional disadvantage is that a complicated coating apparatus is required for this.

SUMMARY

In an aspect of this disclosure, there is provided a slide curtain coating apparatus and slide curtain coating method wherein coating liquids are applied in the form of a curtain on a running web to form a coating on the surface thereof, the apparatus and method being capable of preventing the curtain from converging to the center of the slide and of preventing the resultant coating from having greater thickness at its edge regions.

In another aspect, a slide curtain coating apparatus includes: a slit configured to discharge a coating liquid; a slide having an inclined surface on which the coating liquid flows down in the form of curtain; a slide edge guide provided at each of both edges of the slide; and auxiliary liquid supply means configured to discharge an auxiliary liquid from all over the surface thereof which touches the curtain at the edge guide.

In the aforementioned slide curtain coating apparatus, the curtain freely falls from the slide and contacts a running web to form a coating thereon. Since the auxiliary liquid supply means discharges an auxiliary liquid from all over the surface thereof which touches the curtain at the slide edge guide, it is possible to prevent deposition of a large amount of coating liquid onto edge regions of the web (i.e., to prevent the resulting coating on the web from having a greater thickness at its edge regions). In this way the coating can be prevented from adhering to any other surface of the web, and the web can be prevented from being torn up when it is rolled, thereby increasing the efficiency of curtain coating. And further, the auxiliary liquid supply means enable to reduce the required amount of the auxiliary liquid to be discharged, and thus the curtain can be almost completely prevented from being mixed with the auxiliary liquid. Thereby the coating can be prevented from having, or being mixed with, the auxiliary liquid at the edge regions.

The surface of each edge guide that makes contact with the auxiliary liquid is preferably made of porous material. With this configuration, it is possible to reduce the flow depth of the auxiliary liquid and to minimize the flow unevenness of the auxiliary liquid on the slide, thereby providing a coating having uniform thickness across its width.

The porous material preferably has an average pore size of 50 μm or smaller. With such a configuration, the auxiliary liquid supply means is able to stabilize and equalize the flow rate of the auxiliary liquid and, thus, the curtain, preventing the coating thickness at edge regions from being thicker than the center region. Thereby the coating can be prevented from adhering to the other surface of the web, and the web can be prevented from being torn up when the web is rolled, increasing the efficiency of curtain coating.

The porous material preferably has a porosity of 30% or higher. In such a configuration, the auxiliary liquid supply means enables to uniformly supply the auxiliary liquid on the slide, stabilize and equalize the flow rate of the curtain, prevent the coating thickness at edge regions from being thicker than the center region, and thereby the coating can be prevented from adhering to any other surface of the web, and the web can be prevented from being torn up when it is rolled, increasing the efficiency of curtain coating.

The height of the auxiliary liquid supply means is preferably equal to the thickness, or depth, of the flowing curtain. With this configuration, the curtain can be prevented from being mixed with the auxiliary liquid, and thereby the edge regions of the resulting coating can be prevented from being mixed with the auxiliary liquid.

In the aforementioned slide curtain coating apparatus, the height of the auxiliary liquid supply means is preferably made equal to the thickness of the curtain, and also, a thickness regulator is preferably provided on the auxiliary liquid supply means in such a manner that the contact angle between the thickness regulator and the auxiliary liquid is 90° or wider. By supplying the auxiliary liquid on the slide and providing the auxiliary liquid supply means and thickness regulator in such manner, it is possible to make the thicknesses of the edge regions of the curtain equal to the thickness of its center region. And thus, the resulting coating can be formed with uniform thickness, preventing it from adhering to any other surface of the web. In addition the web is prevented from being torn up when it is rolled, thereby increasing the efficiency of curtain coating.

In the slide curtain coating apparatus, the height of flowing auxiliary liquid being discharged from and adjacent to the auxiliary liquid supply means is preferably controlled at the level equal to the thickness of the curtain. In such a configuration, the curtain of coating liquid can be prevented from being mixed with the auxiliary liquid, and thereby the edge regions of the resulting coating can be prevented from mixed with the auxiliary liquid.

In the aforementioned slide curtain coating apparatus, a plurality of coating liquids is discharged from the corresponding number of slits, and flows down the inclined surface of a slide while being laminated as a curtain, and the curtain falls freely from the slide and contacts a running web, forming a coating thereon, wherein the method is characterized in that an auxiliary liquid is supplied from auxiliary liquid supply means at a pair of slide edge guides provided at opposing edges on the slide, the auxiliary liquid supply means discharges the auxiliary liquid from all over the surface thereof which touches the curtain. The height of flowing auxiliary liquid discharged from the auxiliary liquid supply means is preferably equal to the thickness of the curtain.

In such a slide curtain coating method, it is possible to prevent the edge regions of the coating from having greater a thickness than its center region, preventing the coating from adhering to any other surface of the web. In addition, the web is prevented from being torn up when it is rolled, increasing the efficiency of curtain coating. And further, the auxiliary liquid supply means expanding all over the surface of each slide edge guide that touches the curtain achieves a reduction in the amount of auxiliary liquid needed to be discharged, and thus the curtain can be almost completely prevented from being mixed with the auxiliary liquid. Thereby the coating can be prevented from being mixed with the auxiliary liquid.

The slide curtain coating apparatus preferably includes a recovery blade at the downstream of each slide edge guide as means for collecting the auxiliary liquid that has been discharged from the auxiliary liquid supply means.

With this configuration, as the flowing auxiliary liquid is collected by the recovery blade, it is possible to prevent the curtain from being mixed with the auxiliary liquid and the resulting coating from having greater thickness at its edge regions, thereby the coating can be prevented from adhering to the other surface of the web, and the web will not be easily torn up when it is rolled, increasing the efficiency of curtain coating.

In the aforementioned slide curtain coating apparatus, it is preferable to provide recovery means at each edge for collecting the flowing auxiliary liquid at the downstream of the slide edge guide by means of recovery blade, while moving the position of each slide edge guide facing the auxiliary liquid and curtain from the edge of the flow of the curtain by a distance corresponding to the flow width of the auxiliary liquid.

With this configuration, it is possible to prevent the curtain from being mixed with the auxiliary liquid and the coating from having greater thickness at its edge regions, thereby the coating can be prevented from adhering to the other surface of the web. In addition the web will not be easily torn up when it is rolled, increasing the efficiency of curtain coating.

In the curtain coating apparatus with the recovery blade, the length of the blade is preferably equal to the flow width of the auxiliary liquid flowing between the auxiliary liquid supply means and the edge of the flowing curtain.

In the slide coating apparatus with the recovery blade provided in such a manner, it is possible to prevent the curtain from being mixed with the auxiliary liquid and the coating from having greater thickness at its edge regions, thereby the coating can be prevented from adhering to any other surface of the web. In addition, the web will not be easily torn up when it is rolled, increasing the efficiency of curtain coating.

In the aforementioned slide curtain coating apparatus, suction means is preferably provided for suctioning a flowing auxiliary liquid, which has been discharged from the auxiliary supply means, through a path formed at the downstream of each slide edge guide.

With the curtain coating apparatus with such suction means, it is possible to prevent the curtain from being mixed with the auxiliary liquid and the coating from having greater thickness at its edge regions, thereby the coating can be prevented from adhering to any other surface of the web, and the web will not be easily torn up when it is rolled, increasing the efficiency of curtain coating.

In the aforementioned slide curtain coating apparatus, it is preferable to provide suction means at each edge to collect flowing auxiliary liquid at the downstream of each slide edge guide, while moving the position of each of the slide edge guide facing the auxiliary liquid and curtain from the edge of the flow of the curtain by a distance corresponding to the flow width of the auxiliary liquid.

With the curtain coating apparatus having the suction means provided in such a manner, it is possible to prevent the curtain from being mixed with the auxiliary liquid and the coating from having greater thickness at their edge regions, thereby the coating can be prevented from adhering to the other surface of the web, and the web will not be easily torn up when the web is rolled, increasing the efficiency of curtain coating.

The curtain coating apparatus with the recovery blade preferably contains a suction means at the downstream of the slide edge guides for suctioning the auxiliary liquid collected by means of the recovery blade. With such a curtain coating apparatus having the recovery blades and suction means, it is possible to more effectively prevent the curtain from being mixed with the auxiliary liquid and the coating from having greater thickness at its edge regions, thereby the coating can be highly effectively prevented from adhering to the other surface of the web, and the web will not be easily torn up when the web is rolled, increasing the efficiency of curtain coating.

In the aforementioned curtain coating method, coating liquids are discharged through respective slits, flow as a curtain down the inclined surface of the slide, and freely fall from the slide and contact the running web, forming the coating thereon, wherein the method is characterized in that the auxiliary liquid is provided from the auxiliary liquid supply means at the slide edge guides provided at opposing edges of the slide, the auxiliary liquid supply means discharges the auxiliary liquid from all over the surface thereof which touches the curtain, and the flowing auxiliary liquid is then suctioned with the suction means through the path formed at the end of the slide edge guides at the downstream.

In the aforementioned curtain coating method, coating liquids are discharged through respective slits, flow as a curtain down the inclined surface of the slide, and freely fall from the slide and contact the running web, forming the coating thereon, wherein the method is characterized in that the aforementioned slide curtain coating apparatus which has the suction means is used to discharge the auxiliary liquid from all over a surface which touches the curtain at a slide edge guide, and to suction the auxiliary liquid at the downstream of the slide edge guide, with the position of the slide edge guide being moved in the direction opposite to the discharge direction of the auxiliary liquid from the slide edge guide by a distance corresponding to the flow width of the auxiliary liquid.

The aforementioned slide curtain coating method is further characterized in that the flowing auxiliary liquid is collected using the above-stated curtain coating apparatus provided with the recovery blade at the downstream of each slide edge guide.

The aforementioned slide curtain coating method is further characterized in that the flowing auxiliary liquid is collected at the downstream of the slide edge guide by means of recovery blade, while moving the position of each slide edge guide facing the auxiliary liquid and curtain from the edge of the flow of the curtain by a distance corresponding to the flow width of the auxiliary liquid.

In the slide curtain coating apparatus with such recovery blades, it is preferred that the auxiliary liquid collected through the recovery blades be suctioned with the suction means through the path formed at the end of the slide edge guides at the downstream.

The height of the auxiliary liquid being discharged from the auxiliary liquid supply means is preferably equal to the thickness of the curtain.

According to the aforementioned slide curtain coating method, it is possible to prevent the edge regions of the resulting coating from having greater thickness than its center region, preventing the coating from adhering to any other surface of the web. In addition the web is prevented from being torn up when it is rolled, increasing the efficiency of curtain coating. And further, the auxiliary liquid supply means expanded to the entire contact area at the surface of the slide edge guides enable to reduce the required amount of the auxiliary liquid to be discharged, and thus the auxiliary liquid can be almost completely prevented from being mixed with the curtain. Thereby the coating can be prevented from having non-uniform thickness in a direction lateral to web motion, the non-uniformity being caused when the curtain is mixed with the auxiliary liquid. In addition, by moving the position of each of the slide edge guides from the edge of the flow of the curtain by a distance corresponding to the flow width of the auxiliary liquid, by providing a recovery blade for collecting a flowing auxiliary liquid, or by adopting these means in combination, it is possible to further effectively achieve improvements corresponding to the selected means. It is also desirable that the height of flowing auxiliary liquid be controlled at a level equal to the height of the curtain for more improvement.

In the slide curtain coating apparatus, it is preferred that the static surface tension of the auxiliary liquid be in the range of from 10 mN/m lower to 30 mN/m higher than that of the coating liquid. By this, the static surface tensions of the coating liquid and auxiliary liquid are balanced, and the resulting coating can be prevented from having greater thickness at its edge regions, and thereby the coating can be prevented from adhering to any other surface of the web, and the web can be prevented from being torn up when it is rolled, increasing the efficiency of curtain coating.

DETAILED DESCRIPTION OF THE INVENTION

Hereinafter, preferred embodiments of the present invention will be described with reference to the accompanying drawings.

First Embodiment

Figure 1:
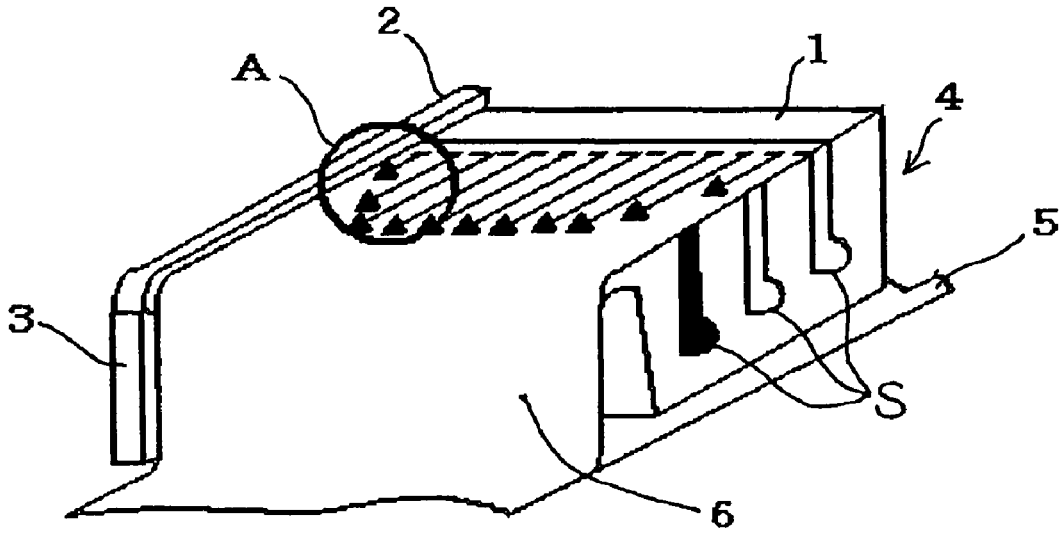
FIG. 1 PRIOR ART
FIG. 1 shows an example of a conventional curtain coating apparatus.
Figure 2:
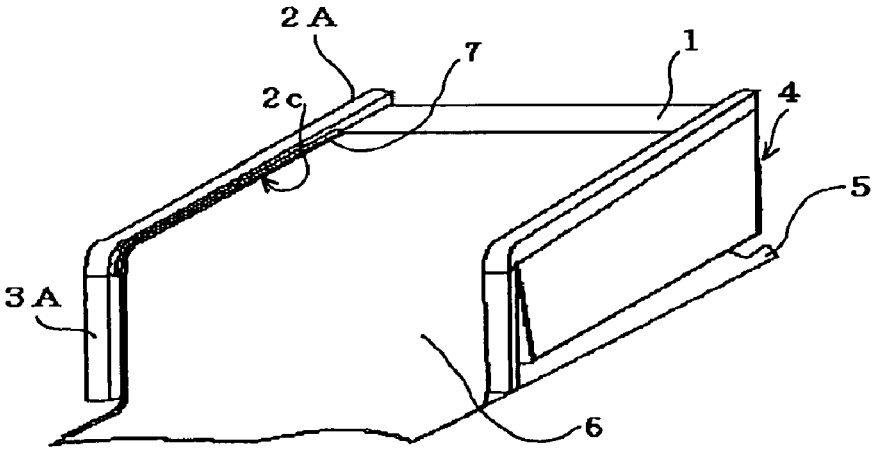
FIG. 2 shows an embodiment of the slide curtain coating apparatus of the present invention.

FIG. 2 shows a slide curtain coating apparatus in accordance with first embodiment of the invention. Likewise to the curtain coating apparatus of FIG. 1, the slide curtain coating apparatus 4 shown in FIG. 2 includes a plurality of slits S as means for discharging the corresponding number of coating liquids to form a curtain 6 which is composed of layers of the coating liquids; a slide 1 on whose inclined surface the curtain 6 naturally flows; a pair of slide edge guides 2A which are provided on opposing edges of the slide 1 and along which the curtain 6 flows; and, a pair of curtain edge guides 3A at opposing edges at the downstream of the slide. In addition to these known components, in particular, the slide curtain coating apparatus 4 further includes an auxiliary liquid supply mechanism for discharging the auxiliary liquid 7 from the entire surface of the inner surface 2*c* of each of the slide edge guides 2A, which inner surface 2*c* is in contact with the curtain 6. A web 5 runs on a conveyor (not shown) beneath the slide curtain coating apparatus 4.

Figure 3:
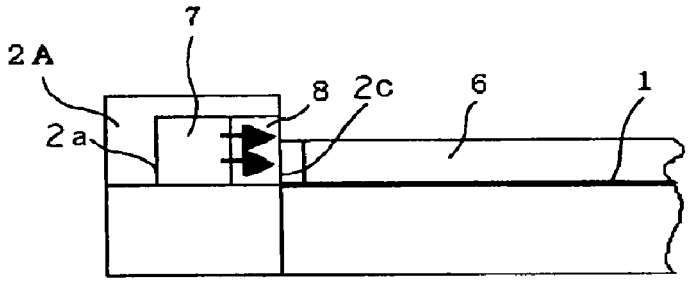
FIG. 3 is a cross-sectional view showing an example of the slide edge guide of the slide curtain coating apparatus of FIG. 2.

FIG. 3 is a cross-sectional view showing one of the slide edge guides of the slide curtain coating apparatus of FIG. 2. The other slide edge guide is not shown as it is identical. As shown in FIG. 3, an auxiliary liquid supplying path 2*a* through which the auxiliary liquid 7 passes is formed inside the slide edge guide 2A (hereinafter may be simply referred to as "edge guide 2A") A wall member 8 that contacts the curtain 6 may be made of porous material or may be provided with very small slits therein such that the auxiliary liquid 7 in the auxiliary liquid supplying path 2*a* can pass through it. More specifically, the wall member 8 is so configured that the auxiliary liquid 7 in the auxiliary liquid supplying path 2*a* exudes to, and is constantly held on the surface of the wall member 8 (i.e., the inner surface of the edge guide 2A that contacts the curtain 6) in an appropriate amount. The auxiliary liquid 7 is fed from a supply section (not shown).

The coating liquids 6 discharged through the slits S on the inclined surface of the slide 1 are laminated in the form of curtain 6, and move down the slide 1 by the force of gravity. At this point, the curtain 6 contacts the auxiliary liquid 7 at its ends, whereby the generation of converged flows as seen in the prior art is prevented and thus thickening of the edges of the curtain 6 can be prevented. The curtain 6 then falls from the slide 1 and contacts the running web 5, forming a coating thereon.

In this slide curtain apparatus 4, the auxiliary liquid 7 is discharged from the entire surface 2*c* of each of the opposing edge guides 2A on the slide 1, which surface 2*c* is in contact with the curtain 6. With this configuration, the flow rates of portions of the curtain 6 near the edges of the slide 1 increase, and thereby the difference in flow rate between the center and edges of the curtain 6 becomes small, preventing edge flows from converging to the center and preventing the resulting coating from having greater thickness at its edge regions.

In addition, with the configuration described above, the slide curtain coating apparatus 4 can reduce the amount of the auxiliary liquid 7 needed to be discharged and thus prevent the curtain 6 and the resulting coating from being mixed with the auxiliary liquid 7 at their edge regions by discharging an adequate amount of auxiliary liquid 7 from the entire contact area 2*c*.

The auxiliary liquid 7 is not particularly limited as long as it is liquid, i.e., has fluidity. Examples thereof include aqueous liquids, among which preferred are water and aqueous preparations obtained by mixing water with resin, surfactant or the like; and solvent-based liquids, among which preferred are solvents suitably contained in the curtain 6 and solvent preparations obtained by mixing the solvents with resin, surfactant or the like.

It is preferred that the static surface tension of the auxiliary liquid 7 be in the range of from 10 mN/m lower to 30 mN/m higher and further preferably in the range of from 5 mN/m lower to 20 mN/m higher than that of the coating liquids. When the static surface tension of the auxiliary liquid 7 is 10 mN/m lower than that of the coating liquids, the auxiliary liquid 7 may be drawn toward the curtain 6 flowing down the slide 1, causing the resulting coating to be mixed with a significant amount of the coating liquids at the edge regions. On the other hand, when the static surface tension of the auxiliary liquid 7 is 30 mN/m higher than that of the coating liquids, the curtain 6 may be drawn toward the auxiliary liquid 7 while flowing down the slide 1 and thus the coating liquid may be reduced at the edge regions, resulting in significantly insufficient amount of the coating thickness at the edge regions of the resulting coating.

The slide curtain coating method of the present invention may be performed with the above-stated slide curtain coating apparatus 4 which basically discharges the auxiliary liquid 7 from the contact area 2*c* at the slide edge guides 2A provided at both edges of the slide 1 to supply a small amount of the auxiliary liquid 7 at the edge regions of the curtain 6. Thereby, the flow rates at the edge regions of the curtain 6 are increased to minimize the difference in flow rate between the center region and the edge regions of the curtain 6, preventing the flow of the curtain 6 from being converged to the center, and preventing the resulting coating from having greater thickness at its edge regions.

By discharging the auxiliary liquid 7 from the entire surface 2*c* of each of the opposing edge guides 2A on the slide 1, the surface 2*c* being in contact with the curtain 6, it is possible to reduce the amount of auxiliary liquid needed to be discharged and to prevent the curtain 6 and the resulting coat on the running web 5 from being mixed with the auxiliary liquid 7 at the edge regions.

By adjusting the height of the auxiliary liquid 7 discharged between the slide edge guide 2A and the curtain 6 to a level equal to the height (thickness) of the curtain 6 as shown in FIG. 3, it is also possible to prevent the curtain 6, or the coating liquids, from being mixed with the auxiliary liquid 7.

Second Embodiment

Figure 4:
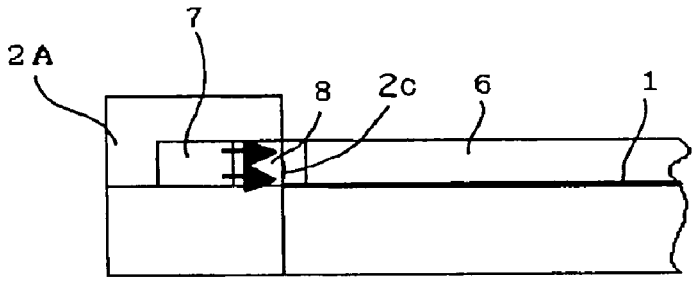
FIG. 4 is a cross-sectional view showing another example of the slide edge guide of the slide curtain coating apparatus of FIG. 2.

The wall member 8 shown in FIG. 4 is preferably made of porous material in the slide curtain coating apparatus 4 with the above-stated configuration. When the wall member 8 serves as a porous material member 8, it is possible to minimize the flow depth of the auxiliary liquid 7 and the flow unevenness of the auxiliary liquid 7. Thus, it is possible to prevent thickness unevenness of the edge regions of the coating formed on the web 5. Examples of the porous material include ceramic, TEFLON®, stainless steel and aluminum.

When the height of the porous material member 8 is adjusted at a level equal to the thickness of the curtain 6 as shown in FIG. 4, it is possible to effectively prevent the curtain 6 from being mixed with the auxiliary liquid 7 at the edge regions. When the porous material 8 has an average pore size of 50 μm or smaller and a porosity of 30% or higher, it is possible to stabilize and equalize the flow rate of the auxiliary liquid 7 as well as the curtain 6, in the lateral direction, and thus the flow of the curtain 6 can be prevented from being condensed at its center.

Third Embodiment

Figure 5:
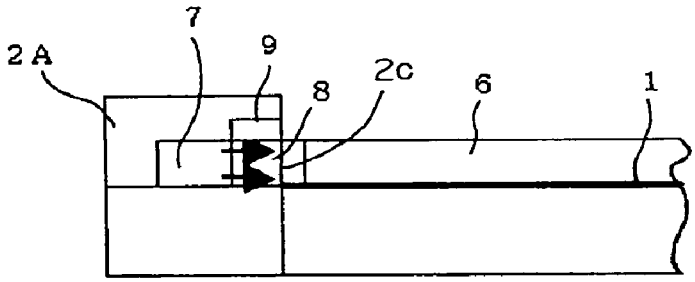
FIG. 5 is a cross-sectional view showing an example of the slide edge guide of the slide curtain coating apparatus in accordance with the third aspect of the present invention.
Figure 6A:
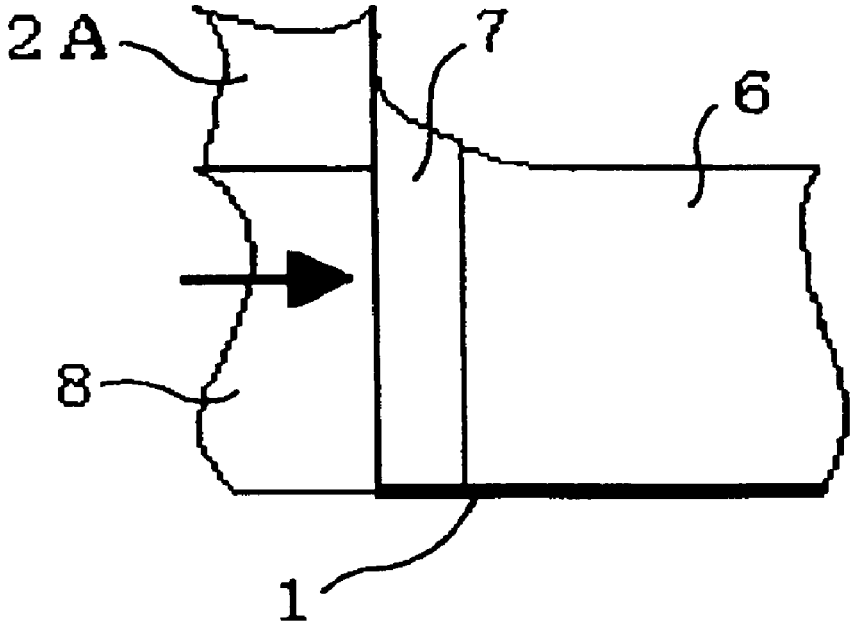
FIG. 6A is a cross-sectional view showing a first example of the slide edge guide of the slide curtain coating apparatus in accordance with third embodiment of the present invention.
Figure 6B:
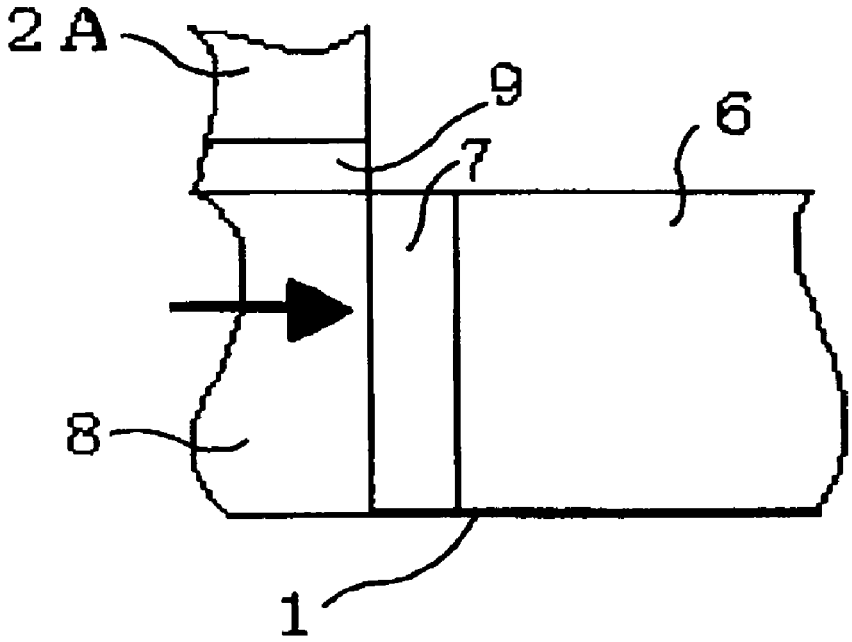
FIG. 6B is a cross-sectional view showing a second example of the slide edge guide of the slide curtain coating apparatus in accordance with third embodiment of the present invention.

In the above-described configuration where the height of the porous material member 8 is made equal to the height of the coating liquid, it is further preferable, as shown in FIG. 5, to provide a thickness regulator 9 on the porous material member 8 in such a manner that the contact angle between the thickness regulator 9 and the auxiliary liquid 7 is 90° or wider. In such a configuration, the thickness regulator 9 can lower the height of the curtain 6 at its edge regions and thus can make the height of the edge regions of the curtain 6 equal to the height of the center region. It is thus possible to prevent the edge regions of the curtain 6 from having greater thickness. The comparison between with and without the thickness regulator 9 is shown in FIGS. 6B and 6A. Preferred examples of materials that can be used for the thickness regulator 9 include ceramic, TEFLON®, stainless steel and aluminum.

Fourth Embodiment

Figure 7:
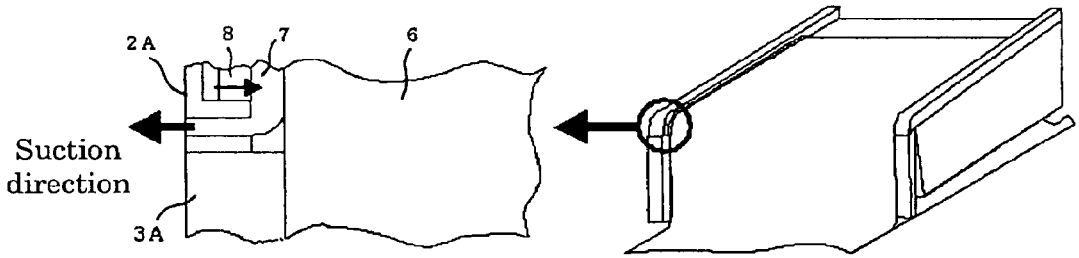
FIG. 7 is a cross-sectional view showing an example of the slide edge guide of the slide curtain coating apparatus in accordance with fourth embodiment of the present invention.

In addition to the above described configuration, a suction means is preferably provided in fourth embodiment. In fourth embodiment shown in FIG. 7, suitably-selected suction means (not shown) is provided at each slide edge guide 2A for suctioning at the downstream of the slide edge guide 1 the auxiliary liquid 7 that has been discharged from the surfaces of the opposing edge guides 2A that contact the curtain 6. In this way the curtain 6 is prevented from being mixed with the auxiliary liquid 7, and it is thus possible to prevent mixing of the curtain 6 and auxiliary liquid 7 and to prevent the edge regions of the curtain 6 from having greater thickness.

Fifth Embodiment

Figure 8:
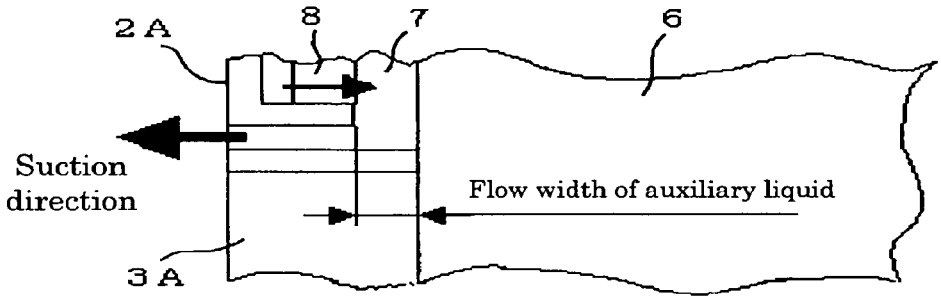
FIG. 8 is a cross-sectional view showing an example of the slide edge guide of the slide curtain coating apparatus in accordance with fifth embodiment of the present invention.

In fifth embodiment shown in FIG. 8, the position of the slide edge guide 2A facing the auxiliary liquid 7 and curtain 6 is moved in the direction opposite to the discharge direction of the auxiliary liquid 7 from the edge guide 2A by a distance corresponding to the flow width of the auxiliary liquid 7, wherein a suction means is provided in accordance with the above-stated configuration to suction at the downstream of the slide edge guides 2A the auxiliary liquid 7. In such a configuration, the curtain 6 can be prevented from being mixed with the auxiliary liquid 7, and thereby the edge regions of the resulting coating on the web can be more effectively prevented from being mixed with the auxiliary liquid 7 and from having greater thickness at its edge regions.

Sixth Embodiment

Figure 9:
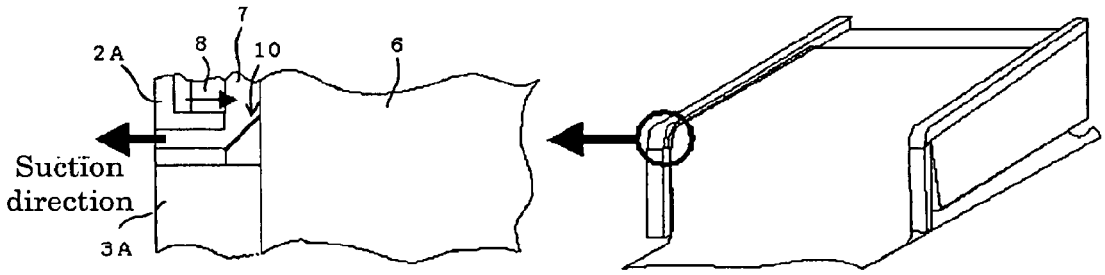
FIG. 9 is a cross-sectional view showing an example of the slide edge guide of the slide curtain coating apparatus in accordance with sixth embodiment of the present invention.

In sixth embodiment shown in FIG. 9, the flowing auxiliary liquid 7 discharged from the surfaces of the edge guides 2A that contact the curtain 6 is collected with a recovery blade 10 that is provided at the downstream of each slide edge guide 2A. In such a configuration, the curtain 6 can be prevented from being mixed with the auxiliary liquid 7, and thereby the edge regions of the resulting coating on the web can be prevented from being mixed with the auxiliary liquid 7 and from having greater thickness at its edge regions.

In addition, the recovery blade 10 in the above-stated configuration may be provided in such a manner that the horizontal length of the recovery blade 10 is equal to the flow width of the auxiliary liquid 7 between the porous material member 8 and curtain 6, thereby more effectively preventing the curtain 6 from being mixed with the auxiliary liquid 7.

Seventh Embodiment

Still another embodiment will be explained hereinafter. In the embodiment shown in FIG. 10, the position of the slide edge guide 2A facing the auxiliary liquid 7 and curtain 6 is moved in the direction opposite to the discharge direction of the auxiliary liquid 7 from the edge guide 2A by a distance corresponding to the flow width of the auxiliary liquid 7, wherein a recovery blade 10 is provided to collect the flowing auxiliary liquid 7 at the downstream of the slide edge guide 2A.

Also in such a configuration, the curtain 7 can be prevented from being mixed with the auxiliary liquid 6, and thereby the edge regions of the resulting coating on the web can be prevented from being mixed with the auxiliary liquid 7 and from having greater thickness at its edge regions. The slide curtain coating apparatus in this embodiment further includes a suction means configured to suction the auxiliary liquid 7 collected by the recovery blade 10. By providing such a suction means in the above-stated configuration, the curtain 7 can be more effectively prevented from being mixed with the auxiliary liquid 6, and thereby the edge regions of the resulting coating on a web can be further effectively prevented from being mixed with the auxiliary liquid 7 and from having greater thickness at its edge regions.

Also in the above configuration, the recovery blade 10 may be provided in such a manner that the horizontal length of the recovery blade 10 is equal to the flow width of the auxiliary liquid 7 between the porous material member 8 and curtain 6, to thereby enhance the capability of the recovery blade 10 to prevent the curtain 6 from being mixed with the auxiliary liquid 7.

The slide curtain coating method of the present invention is a method including the step of discharging coating liquids through the slits on the slide such that they flow as layers or curtain down the inclined surface of the slide and freely fall from the slide and contacts the running web to form a coating thereon, wherein the method is characterized in that the auxiliary liquid is discharged from all over the surfaces of the opposing edge guides on the slide, which surfaces being in contact with the curtain. It is thus possible to prevent the flow of the curtain from converging to the center region and to prevent the resulting coating from having greater thickness at the edge regions. The present invention will be understood more readily with reference to the following Examples and Comparative Examples; however, these are intended to illustrate the invention and should not be construed as limiting the scope of the present invention.

EXAMPLES

Example 1

As shown in FIGS. 2 and 3, a 5-mm-high ceramic piece having an average pore size of 50 μm and a porosity of 52% was mounted as a porous material member 8 to a surface each slide edge guide 2A that contacts a curtain 6. As an auxiliary liquid 7, water having a static surface tension of 72.6 mN/m as measured with CBVP-A3 (a FACE Automatic Surface Tensiometer manufactured by Kyowa Interface Science Co., Ltd.) was discharged from the all over the surfaces of the ceramic pieces to flow over the slide.

Figure 11:
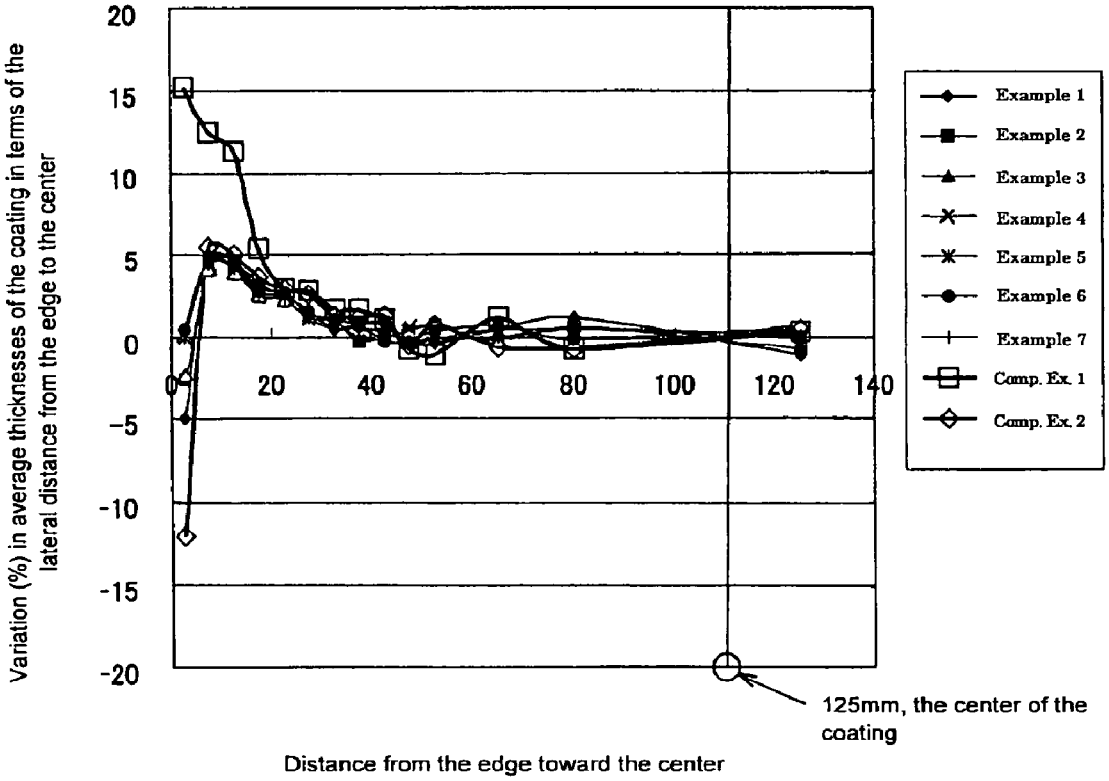
FIG. 11 shows a graph of variation in the coating thickness vs. distance from the edge of the coatings obtained in Examples and Comparative Examples.

A coating liquid (having a viscosity of 300 mPa·s and static surface tension of 35 mN/m) having the below mentioned ingredients was applied on a web (paper) by slide curtain coating under the following conditions: coating speed=400 mm/min; coating width=250 mm; and flow rate of coating liquid discharged through slits=3,000 g per minute. The variation of the average thickness across the width of the resulting coating was measured with X-Rite 938 (a color differential meter manufactured by X-Rite, UK; aperture=5 mm) by assaying the amounts of deposit on the web over the half width (from center to one edge). The measurements are shown in FIG. 11. The edge regions of the coating were checked for the occurrence of mixing between the coating liquid and auxiliary liquid. The results are shown in Table 1.

—Ingredients of Coating Liquid—

85 parts by mass of polyvinyl alcohol 5 parts by mass of a green pigment 915 parts by mass of water Example 2

The coating liquid of Example 1 was applied to paper and the resulting coating was investigated in the same manner as in Example 1, except that the height of the ceramic pieces was made equal to the height of the thickness of the curtain (2.5 mm). The obtained results are shown in Table 1 and FIG. 11.

Example 3

The coating liquid of Example 1 was applied to paper and the resulting coating was investigated in the same manner as in Example 1, except that the height of the ceramic pieces was made equal to the height of the thickness of the curtain (2.5 mm), and that a 5 mm thick TEFLON®-coated piece was provided on the ceramic piece as the thickness regulator 9 in FIG. 5 in such a manner that the contact angle to water was 127° as measured with CA-D contact angle meter (a FACE contact angle meter manufactured by Kyowa Interface Science Co., Ltd.). The obtained results are shown in Table 1 and FIG. 11.

Example 4

The coating liquid of Example 1 was applied to paper and the resulting coating was investigated in the same manner as in Example 1, except that upon coating the auxiliary liquid was suctioned at the downstream of the slide edge guides 2A. The thus obtained results are shown in Table 1 and FIG. 11.

Example 5

The coating liquid of Example 1 was applied to paper and the resulting coating was investigated in the same manner as in Example 4, except that, as shown in FIG. 8, the position of each slide edge guide facing the auxiliary liquid and curtain was moved in the direction opposite to discharge of the auxiliary liquid by a distance corresponding to the flow width of the auxiliary liquid (0.5 mm). The obtained results are shown in Table 1 and FIG. 11.

Example 6

The coating liquid of Example 1 was deposited onto paper and the resulting coating was investigated in the same manner as in Example 2, except that a 0.5 mm long recovery blade and suction means were provided at the downstream of each slide edge guide 2A for collecting and suctioning the flowing auxiliary liquid. The obtained results are shown in Table 1 and FIG. 11.

Example 7

Figure 10:
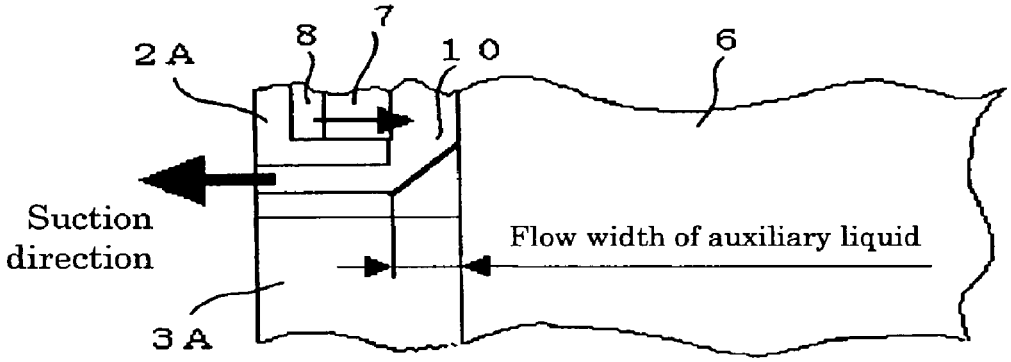
FIG. 10 is a cross-sectional view showing an example of the slide edge guide of the slide curtain coating apparatus in accordance with seventh embodiment of the present invention.

The coating liquid of Example 1 was deposited onto paper and the resulting coating was investigated in the same manner as in Example 6 except that, as shown in FIG. 10, the position of each slide edge guide facing the auxiliary liquid and curtain was moved in the direction opposite to discharge of the auxiliary liquid by a distance corresponding to the flow width of the auxiliary liquid (0.5 mm) The obtained results are shown in Table 1 and FIG. 11.

Example 8

The coating liquid of Example 1 was deposited onto paper and the resulting coating was investigated in the same manner as in Example 4, except that as an auxiliary liquid a solution prepared by adding a surfactant to water such that the solution has a static surface tension of 54 mN/m was used. The obtained results are shown in Table 1 and FIG. 12.

Example 9

The coating liquid of Example 1 was deposited onto paper and the resulting coating was investigated in the same manner as in Example 4, except that as an auxiliary liquid a solution prepared by adding a surfactant to water such that the solution has a static surface tension of 28 mN/m was used. The obtained results are shown in Table 1 and FIG. 12.

Comparative Example 1

The coating liquid of Example 1 was deposited onto paper and the resulting coating was investigated in the same manner as in Example 1, except that no auxiliary liquid was supplied. The obtained results are shown in Table 1 and FIG. 11.

Comparative Example 2

The coating liquid of Example 1 was deposited onto paper and the resulting coating was investigated in the same manner as in Example 1, except that water as an auxiliary liquid was supplied from the upstream of the slide along the slide edge guides. The obtained results are shown in Table 1 and FIG. 11.

TABLE 1

| | Existence of auxiliary liquid at the edge regions of coating |
|---|---|
| Example 1 | Confirmed |
| Example 2 | Faintly confirmed |
| Example 3 | Faintly confirmed |
| Example 4 | Not confirmed |
| Example 5 | Not confirmed |
| Example 6 | Not confirmed |
| Example 7 | Not confirmed |
| Example 8 | Not confirmed |
| Example 9 | Not confirmed |
| Comp. Ex. 1 | Not confirmed |
| Comp. Ex. 2 | Confirmed |

(Evaluation and Result)

As FIG. 11 indicates, it was established that discharging an auxiliary liquid from all over the surface of each slide edge guide that contacts the curtain resulted in successfully obtaining a coating with a thickness tolerance of ±5% in terms of edge regions across its width, an acceptable range of variation in practice, It was established that the curtain can be prevented from being mixed with the auxiliary liquid at the edge regions by collecting the flowing auxiliary liquid at the downstream of the slide edge guides.

Figure 12:
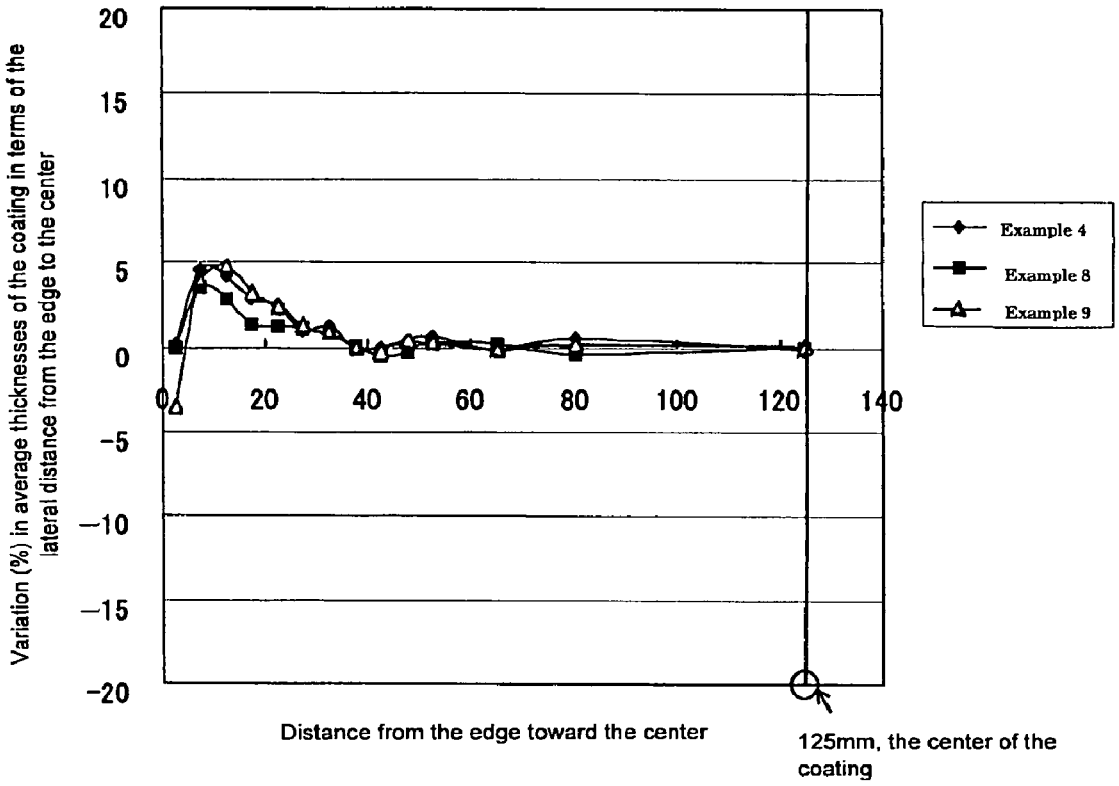
FIG. 12 shows a graph of variation in the coating thickness vs. distance from the edge of the coatings obtained in Examples.

As FIG. 12 indicate, it was established that making the static surface tension of the curtain substantially equal to that of the auxiliary liquid resulted in further small variations in the thickness of edge regions the coating across its width.

In accordance with the present invention, the present invention can solve conventional problems and provide a slide curtain coating apparatus and slide curtain coating method that can prevent the resulting coating from having greater thickness at the edge regions than at the center region.

What is claimed is:

1. A slide curtain coating method employing a slide curtain apparatus comprising slits configured to discharge coating liquids, a slide having an inclined surface on which the coating liquids flow down as a curtain, a slide edge guide along which the curtain flows, and an auxiliary liquid supply means, the method comprising:

discharging the coating liquids through the respective slits;

allowing the coating liquids to stack on top of each other to form the curtain on slide having the inclined surface; and allowing the curtain to freely fall from the slide for deposition onto a running web to form a coating thereon;

the slide edge guide being provided at each of both edges of the slide; and discharging an auxiliary liquid from the auxiliary liquid supply means all over a surface of the slide edge guide touching the curtain, wherein a member constituting the surface of the slide edge guide which touches the curtain is a porous material member having a porosity of 30% or higher.

2. The slide curtain coating method according to claim 1, wherein the height of the auxiliary liquid flowing between the slide edge guide and the curtain is made equal to the height of the curtain.

3. The slide curtain coating method according to claim 1, wherein the static surface tension of the auxiliary liquid is in the range of 10 mN/m lower to 30 mN/m higher than the static surface tension of the curtain coating liquid.

4. A slide curtain coating method employing a slide curtain apparatus comprising a slit configured to discharge a coating liquid, a slide having an inclined surface on which the coating liquid flows down as a curtain, a slide edge guide along which the curtain flows, and an auxiliary liquid supply means, the method comprising:

discharging an auxiliary liquid from the auxiliary liquid supply means all over a surface of the slide edge guide which touches a curtain of coating liquid, the slide edge guide being provided at each of both edges of the slide; and collecting the auxiliary liquid downstream of the slide edge guide by means of a recovery blade, wherein a member constituting the surface of the slide edge guide which touches the curtain is a porous material member having a porosity of 30% or higher.

5. The slide curtain coating method according to claim 4, wherein the auxiliary liquid is collected at the downstream of the slide edge guide by means of the recovery blade in a state where the position of the slide edge guide is moved in the direction opposite to the discharge direction of the auxiliary liquid from the slide edge guide by a distance corresponding to the flow width of the auxiliary liquid, and wherein a slide curtain coating apparatus is used which comprises a slit configured to discharge the coating liquid; the slide having an inclined surface on which the coating liquid flows down as the curtain; the slide edge guide along which the curtain flows, the slide edge guide being provided at each of both edges of the slide; and auxiliary liquid supply means configured to discharge the auxiliary liquid from all over the surface thereof which touches the curtain at the slide edge guide.

6. The slide curtain coating method according to claim 4, further comprising suctioning the auxiliary liquid collected by means of the recovery blade at downstream of the slide edge guide.

7. The slide curtain coating method according to claim 4, wherein the height of the auxiliary liquid flowing between the slide edge guide and the curtain is made equal to the height of the curtain.

* * * * *